United States Patent [19]

Stapp

[11] Patent Number: 4,560,467

[45] Date of Patent: Dec. 24, 1985

[54] VISBREAKING OF OILS

[75] Inventor: Paul R. Stapp, Bartlesville, Okla.

[73] Assignee: Phillips Petroleum Company, Bartlesville, Okla.

[21] Appl. No.: 722,626

[22] Filed: Apr. 12, 1985

[51] Int. Cl.[4] ..... C10G 29/02; C10G 45/00

[52] U.S. Cl. ..... 208/89; 208/88; 208/106; 208/107; 208/251 R; 208/251 H; 208/68; 208/73

[58] Field of Search ..... 208/106, 107, 113, 88, 208/251 R, 251 H, 89, 68, 73

[56] References Cited

U.S. PATENT DOCUMENTS

| | | | |
|---|---|---|---|
| 1,950,460 | 3/1934 | Steffen | 208/107 |
| 2,368,939 | 2/1945 | Martin et al. | 208/107 |
| 2,666,022 | 1/1954 | Johnson | 196/49 |
| 2,772,221 | 11/1958 | Stewart et al. | 196/50 |
| 2,917,532 | 12/1959 | Watkins | 208/107 |
| 2,989,460 | 6/1961 | DuBois Eastman | 208/107 |
| 3,118,830 | 1/1964 | Schlinger et al. | 208/107 |
| 3,294,678 | 12/1966 | Gleim | 208/309 |
| 3,719,588 | 3/1973 | Vernon et al. | 208/209 |
| 3,720,603 | 3/1973 | Gleim | 208/251 R |
| 3,728,252 | 4/1973 | Pitchford | 208/243 |
| 3,948,759 | 4/1976 | King et al. | 208/106 |
| 4,235,699 | 11/1980 | Ratcliffe et al. | 208/107 |
| 4,389,303 | 6/1983 | Simo et al. | 208/107 |
| 4,391,700 | 7/1983 | Billon et al. | 208/86 |
| 4,427,539 | 1/1984 | Busch et al. | 208/127 |

*Primary Examiner*—D. E. Gantz
*Assistant Examiner*—Anthony McFarlane
*Attorney, Agent, or Firm*—K. K. Brandes

[57] ABSTRACT

A hydrocarbon containing feed stream, e.g., a heavy oil or residuum, is contacted under suitable reaction conditions with a carbon monoxide containing gas, so as to produce a hydrocarbon stream having a reduced level of metal impurities, especially nickel and vanadium compounds, and an increased API$^{60}$ gravity, essentially in the absence of a catalyst or extractant.

20 Claims, No Drawings

VISBREAKING OF OILS

BACKGROUND OF THE INVENTION

This invention relates to an improved process for upgrading hydrocarbon feed streams, especially heavy oils. In another aspect, this invention relates to a non-catalytic, non-extractive process for upgrading heavy oils.

It is well known that heavy crude oils, as well as products from extraction and/or liquefaction of coal and lignite, products from tar sands and oil shale and similar products may contain metals such as nickel and vanadium. The presence of these metals makes further processing of heavier fractions difficult since the metals generally act as poisons for catalysts employed in processes such as catalytic hydrodesulfurization, hydrogenation and catalytic cracking. It is further known that heavy oils are quite viscous due to the high content of high molecular weight carbonaceous materials called heavies. It is frequently necessary to break down a portion of these heavies in a pretreatment operation so as to facilitate the transport of heavy oils through pipelines to refineries.

SUMMARY OF THE INVENTION

It is thus an object of this invention to provide a process for at least partially removing metals from substantially liquid hydrocarbon containing feed streams and thus to improve the processability of said streams. It is another object of the invention to increase the API gravity (i.e., decrease the density) of hydrocarbon containing feed streams, so as to improve their flowability and processability. It is a further object of this invention to provide a non-catalytic, non-extractive process for upgrading hydrocarbon containing feed streams.

In accordance with the instant invention, a hydrocarbon containing feed stream, which contains metal compounds as impurities, is contacted at an elevated temperature with a gas comprising carbon monoxide, said contacting being carried out essentially in the absence of a homogenous or heterogeneous catalyst and essentially in the absence of a second liquid phase which can extract any portion of said hydrocarbon containing feed stream. In one embodiment, a heavy oil feed stream is contacted with a carbon monoxide containing gas at elevated temperature and pressure conditions. In another embodiment, a heavy oil is contacted with a gaseous mixture of carbon monoxide and hydrogen at elevated temperature and pressure conditions. In a further embodiment, a heavy oil is contacted with a gas comprising a mixture of CO, $H_2$ and $H_2S$ at elevated temperature and pressure conditions.

The process of this invention results in the at least partial removal of metals, especially nickel and vanadium, and an increase in API gravity. Generally, the level of other impurities, e.g., coke precursors and sulfur is also reduced. Other objects and advantages of the invention will be apparent from the foregoing brief description and the appended claims, as well as the detailed description of the invention which follows.

DETAILED DESCRIPTION OF THE INVENTION

Any suitable hydrocarbon feed stream, which contains metal impurities, can be employed in this invention. The present invention is particularly applicable to the removal of vanadium and nickel, which are generally bound to heterocyclic compounds such as porphyrins, from said feed stream. Suitable hydrocarbon containing feed streams include crude oils, petroleum products, coal pyrolyzates, products from extraction and/or liquefaction of coal and lignite, products from tar sands, shale oil, products from shale oil, and similar products. Suitable hydrocarbon feed streams include gas oils and cycle oils having a boiling range from about 400° F. to about 1000° F., and residual oils, e.g., having a boiling point higher than about 650° F. The present invention is particularly directed to heavy feed streams such as heavy crude oils or heavy topped crudes which are generally regarded as being too heavy to be distilled. These heavy feed streams contain the highest concentration of metals such as nickel and vanadium and will generally have the lowest API gravity. Typically the feedstocks employed will consist primarily of hydrocarbons, will contain about 10 to about 1000 ppm (parts per million parts by weight) of vanadium and about 5 to about 500 ppm of nickel, and will have an $API^{60}$ (i.e., API gravity measured at 60° F.) in the range of about 4 to about 30, particularly about 5 to about 20. In addition, these heavy feedstocks also contain sulfur and nitrogen impurities and coke precursors.

The upgrading process of this invention comprises contacting a substantially liquid hydrocarbon containing feedstock as described above with a carbon monoxide containing gas under such elevated temperature conditions and for such a period of time as will result in a hydrocarbon containing stream having a reduced content of metals, particularly nickel and vanadium, and having an increased $API^{60}$ gravity.

Any apparatus which will afford an intimate contact of the hydrocarbon containing feed stream with the carbon monoxide containing gas at elevated temperature conditions can be employed. The process is in no way limited to the use of a particular apparatus. The process can be carried out in a batch process, e.g., in an autoclave which can be heated and pressured, and is preferably equipped with internal agitating means or circulating pumping means. Or the process can be employed as a continuous process, e.g., in a tubular reactor through which at least partially mixed streams of hydrocarbon feed and treating gas flow. The tubular reactor is equipped with heating means and can have static mixing means for enhanced treating efficiency. Or the continuous process can be conducted in an autoclave, equipped with heating and mixing means, with one or more inlets for the hydrocarbon feed stream and the CO-containing gas, optionally at least partially premixed, and one or more outlets for the treated product stream, generally located above the inlets. The term hydrocarbon containing feed stream is used herein to refer to both a continuous and a batch process.

In one embodiment, the treating gas can be substantially pure carbon monoxide, or it can be a mixture of carbon monoxide and an inert gas such as nitrogen or carbon dioxide. In a preferred embodiment, a mixture of carbon monoxide and hydrogen is used as the treating gas. Generally the volume ratio of CO to $H_2$ can range from about 1:50 to about 200:1, preferably from about 1:10 to about 10:1, and more preferably from about 1:2 to about 2:1. In a still further embodiment, a mixture of CO, $H_2$ and $H_2S$ is employed as the treating gas. Generally, the volume ratio of CO to $H_2S$ can range from about 1:20 to about 500:1, preferably from about 1:5 to about 10:1. The ratio of CO to $H_2$ in this ternary gas mixture can be the same as outlined for the binary mixture. All volume ratios herein are based on volumes at normal conditions of 25° C. and 1 atm pressure.

The upgrading process of this invention can be carried out at any suitable temperature that will afford a decrease in metals content and an increase in API gravity of the hydrocarbon containing feed stream. Generally the reaction temperature ranges from about 300° C. to about 550° C., preferably from about 380° C. to about 450° C. Higher temperatures than 550° C. may improve the removal of metals but may have adverse effects such as more coke formation, and may also not be desirable for economic reasons.

Any suitable pressure can be utilized in the upgrading process of this invention. The reaction pressure can range from about atmospheric to an economically practical pressure as high as 10,000 psig. Generally the total gas pressure (i.e., pressure of CO, plus $H_2$ and $H_2S$ if present) ranges from about 100 psig to about 10,000 psig, preferably from about 400 psig to about 5,000 psig.

It is within the scope of this invention to dilute the hydrocarbon feed srtream with a suitable, essentially inert solvent such as a high boiling paraffin (e.g., kerosene or light gas oil) before it is contacted with the carbon monoxide containing gas. However, it is outside the scope of this invention to use any dispersed or colloidally dispersed hydrogenation catalyst, such as transition metals or compounds thereof, e.g. molybdenum oxides or nickel oxides, which may be supported by alumina or other inorganic refractory compounds. It is also outside the scope of the invention to employ a second liquid phase that acts as an extractant for any portion of the hydrocarbon feed such as a molten metal carbonate phase.

Any suitable reaction time, i.e., the time of intimate, simultaneous contact of the hydrocarbon containing feed stream and the carbon monoxide containing treating gas under such conditions as will result in a reduced level of metals and an increase of $API^{60}$ gravity, can be selected. In a continuous process, the flow rates of the hydrocarbon feed stream and of the treating gas are adjusted such as to provide the desired reaction time. The actual reaction time will greatly depend on the selection of an effective, yet safe reaction temperature and on the desired degree of demetallization and $API^{60}$ gravity increase. Generally, the reaction time ranges from about 1 minute to 20 hours, more preferably from about 5 minutes to about 5 hours, most preferably from about 10 minutes to about 3 hours.

In the process of this invention, the metal compounds present in the hydrocarbon containing feed stream are at least partially converted to a "sludge", i.e., a precipitate, generally in association with formed coke, dispersed in the liquid portion of said hydrocarbon containing stream. The separation of the metal-containing precipitate from the liquid portion of said hydrocarbon containing stream having a reduced metal content and increased $API^{60}$ gravity can be carried out by any suitable separation means such as distillation or filtration or centrifugation or settling and subsequent draining of the liquid phase.

In accordance with a further embodiment, at least a part of the liquid portion of the hydrocarbon containing stream being substantially free of solids and having reduced metal content and increased $API^{60}$ gravity is separated into various fractions by distillation, optionally under vacuum conditions. The light fractions, e.g., those boiling up to 400° F. at atmospheric pressure, can be used as automotive or aircraft fuels or as refining feedstocks. At least one of the heavy fractions, e.g., those boiling above 400° F. at atmospheric pressure, is generally catalytically hydrotreated for further purification such as in hydrodesulfurization and/or hydrodenitrogenation operations employing well known hydrotreating catalysts. Examples of such catalysts are alumina-supported Group VIB and/or VIII metal compounds, which can be employed in slurry-type or fixed bed operations.

In still another embodiment, the thus hydrotreated hydrocarbon-containing fraction is cracked such as in catalytic processes, e.g. fluidized catalytic cracking processes employing zeolite or other well known cracking catalysts, so as to convert at least a portion of said fraction to hydrocarbons of low molecular weight, such as those contained in gasoline and diesel fuel. If the hydrocarbon containing stream, which has been treated in accordance with this invention, contains only minor sulfur and other impurities, the hydrofining operation as described above may be omitted, and at least one fraction of said stream can be fed directly to a catalytic cracker and treated so as to convert at least a portion of said fraction to hydrocarbons of low molecular weight, such as those contained in gasoline and diesel fuel.

The following example is presented to further illustrate this invention without unduly limiting the scope of this invention.

EXAMPLE I

This example illustrates the non-catalytic upgrading of a heavy oil by heat treatment (visbreaking) with a carbon monoxide containing gas. A stirred autoclave of 300 cc capacity was charged with about 110–150 grams of a Hondo heavy resid (650F+) having an $API^{60}$ gravity of 6.7, and containing 55–59 weight-% of a fraction boiling above 1000° F., 11.8 weight-% Ramsbottom carbon residue, 134.5 ppm (parts per million by weight) nickel, 289 ppm vanadium, 6.1 weight-% sulfur and 0.94 weight-% nitrogen.

The filled autoclave reactor was purged with the gas used for the heat treatment (CO or $H_2$ or $H_2$/CO) and then pressured with the same gas to about 750–1000 psig. The reactor and its contents were heated to 425° C. (797° F.) during a time period of about 1 hour and then maintained at that temperature for one hour. Thereafter, the heater was turned off, and the reactor and its contents were allowed to cool to room temperature. The reactor was vented and slowly opened. The vent gas contained several volume-% $H_2S$. The liquid oil product was filtered and analyzed. Test results are summarized in Table I.

Data in Table I show that heat treatment of the heavy oil feed with carbon monoxide was more effective than with hydrogen in increasing the API gravity, lowering nickel and vanadium content and converting heavies (1000+) to lower boiling products. The oil yield was highest and the coke yield was lowest when a mixture of CO and $H_2$ was employed. Addition of $H_2S$ to CO/$H_2$ resulted in lower Ramsbottom carbon residue than in other invention runs.

Reasonable variations and modifications can be made in this invention without departing from the spirit and scope thereof.

TABLE I

| Run | Gas | Initial Press. (psig) | Product Oil Yield (Wt-%) | Coke Yield (Wt-%) | Product Oil Properties API$^{60}$ Gravity | Ramsbottom C (Wt-%) | ppm Ni | ppm V | Wt-% S | Vol.-% of 1000 F+ |
|---|---|---|---|---|---|---|---|---|---|---|
| 1 (Control) | $H_2$ | 1000 | 75.5 | 8.8 | 22.4 | — | 32 | 67 | — | 23 |
| 2 (Invention) | CO | 750 | 72.7 | 13.5 | 23.7 | 7.9 | 19 | 25 | 5.0 | — |
| 3 (Invention) | CO | 1000 | 63.0 | 12.8 | 23.5 | 7.3 | 18 | 19 | 3.9 | 10 |
| 4 (Invention) | CO + $H_2$ | 500 500 | 78.4 | 8.2 | 22.4 | 8.3 | 31 | 54 | 5.3 | — |
| 5 (Invention) | CO + $H_2$ + $H_2S$ | 400 400 200 | 62.6 | 9.7 | 17.7 | 7.0 | 27 | 30 | 5.4 | — |

I claim:

1. A process for upgrading a substantially liquid hydrocarbon containing feed stream, which also contains metal impurities selected from the group consisting of nickel and vanadium compounds, comprising the step of intimately contacting said feed stream with a carbon monoxide containing gas, at a temperature ranging from about 300° C. to about 550° C. under such reaction conditions as will result in a hydrocarbon containing stream having a reduced level of metal impurities and an increased API$^{60}$ gravity, essentially in the absence of a homogeneous or heterogeneous catalyst and essentially in the absence of a second liquid phase which can extract any portion from the hydrocarbon containing feed stream.

2. A process in accordance with claim 1, wherein the carbon monoxide containing gas also comprises hydrogen.

3. A process in accordance with claim 1, wherein the carbon monoxide containing gas also comprises hydrogen and hydrogen sulfide.

4. A process in accordance with claim 1 wherein the substantially liquid hydrocarbon containing feed stream has an API$^{60}$ gravity ranging from about 4 to about 30, the vanadium content in said feed stream ranges from about 10 to about 1000 ppm, and the nickel content in said feed stream ranges from about 5 to about 500 ppm.

5. A process in accordance with claim 2 wherein the substantially liquid hydrocarbon containing feed stream has an API$^{60}$ gravity ranging from about 4 to about 30, its vanadium content ranges from about 10 to about 1000 ppm, and its nickel content ranges from about 5 to about 500 ppm.

6. A process in accordance with claim 3 wherein the substantially liquid hydrocarbon containing feed stream has an API$^{60}$ gravity ranging from about 4 to about 30, its vanadium content ranges from about 10 to about 1000 ppm, and its nickel content ranges from about 5 to about 500 ppm.

7. A process in accordance with claim 1 wherein said reaction conditions comprise a total gas pressure ranging from about 100 psig to about 10,000 psig.

8. A process in accordance with claim 2 wherein the volume ratio of carbon monoxide to hydrogen ranges from about 1:50 to about 200:1, and said reaction conditions comprise a total gas pressure ranging from about 100 psig to about 10,000 psig.

9. A process in accordance with claim 3, wherein the volume ratio of carbon monoxide to hydrogen ranges from about 1:50 to about 200:1, the volume ratio of carbon monoxide to hydrogen sulfide ranges from about 1:20 to about 500:1, and said reaction conditions comprise a total gas pressure ranging from about 100 psig to about 10,000 psig.

10. A process in accordance with claim 4 wherein said reaction conditions comprise a reaction temperature ranging from about 380° C. to about 450° C., a total pressure ranging from about 400 psig to about 5,000 psig, and a reaction time ranging from about 5 minutes to about 5 hours.

11. A process in accordance with claim 5 wherein the volume ratio of carbon monoxide to hydrogen ranges from about 1:10 to about 10:1, and the said reaction conditions comprise a reaction temperature ranging from about 380° C. to about 450° C., a total pressure ranging from about 400 psig to about 5,000 psig, and a reaction time ranging from about 5 minutes to about 5 hours.

12. A process in accordance with claim 6 wherein the volume ratio of carbon monoxide to hydrogen ranges from about 1:10 to about 10:1, the volume ratio of carbon monoxide to hydrogen sulfide ranges from about 1:5 to about 10:1 and the said reaction conditions comprise a reaction temperature ranging from about 380° C. to about 450° C., a total pressure ranging from about 400 psig to about 5,000 psig, and a reaction time ranging from about 5 minutes to about 5 hours.

13. A process in accordance with claim 1, wherein at least a portion of said metal impurities is converted to a precipitate, comprising the additional step of separating said precipitate from the liquid hydrocarbon stream having a reduced metal content and increased API$^{60}$ gravity.

14. A process in accordance with claim 13, wherein said separating step comprises distillation.

15. A process in accordance with claim 13, wherein said separating step comprises filtration.

16. A process in accordance with claim 14, wherein at least one heavy hydrocarbon-containing fraction resulting from said distillation is catalytically hydrotreated so as to produce a further purified hydrocarbon containing stream.

17. A process in accordance with claim 14, wherein at least one heavy hydrocarbon-containing fraction is catalytically cracked so as to convert at least a portion of said fraction to hydrocarbons of lower molecular weight.

18. A process in accordance with claim 16 wherein said further purified hydrocarbon containing stream is catalytically cracked so as to convert at least a portion of said stream to hydrocarbons of lower molecular weight.

19. A process comprising the step of (A) intimately contacting a substantially liquid hydrocarbon feed stream, which also contains metal impurities selected from the group consisting of nickel and vanadium compounds, with a carbon monoxide containing gas, at a temperature ranging from about 300° C. to about 550° C. under such reaction conditions as will result in a hydrocarbon containing stream having a reduced level of metal impurities and an increased API$^{60}$ gravity, essentially in the absence of a homogeneous or heterogeneous catalyst and essentially in the absence of a second liquid phase which can extract any portion from the hydrocarbon containing feed stream, wherein at least a portion of said metal impurities is converted to a precipitate dispersed in the liquid portion of said hydrocarbon containing stream.

20. A process in accordance with claim 19 further comprising the steps of (B) separating at least one liquid hydrocarbon-containing fraction being substantially free of solids from said hydrocarbon containing stream having a reduced level of metal impurities and an increased API$^{60}$ gravity; and (C) catalytically cracking said fraction so as to convert at least a portion of said fraction to hydrocarbons of lower molecular weight.

* * * * *